US007290612B2

(12) United States Patent
Rogers et al.

(10) Patent No.: US 7,290,612 B2
(45) **Date of Patent: *Nov. 6, 2007**

(54) APPARATUS AND METHOD FOR REVERSE CIRCULATION CEMENTING A CASING IN AN OPEN-HOLE WELLBORE

(75) Inventors: Henry E. Rogers, Duncan, OK (US); Earl D. Webb, Wilson, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 140 days.

This patent is subject to a terminal disclaimer.

(21) Appl. No.: 11/014,350

(22) Filed: Dec. 16, 2004

(65) Prior Publication Data

US 2006/0131018 A1 Jun. 22, 2006

(51) Int. Cl.
*E21B 33/02* (2006.01)
*E21B 33/05* (2006.01)

(52) U.S. Cl. ..... 166/285; 166/379; 166/90.1; 166/88.1; 166/96.1; 166/75.14

(58) Field of Classification Search ..... 166/379, 166/90.1, 93.1, 285, 177.4, 88.1, 96.1, 75.14
See application file for complete search history.

(56) References Cited

U.S. PATENT DOCUMENTS 1,115,717 A * 11/1914 Moser ..... 166/88.1
1,627,945 A * 5/1927 Wigle ..... 166/84.1
1,629,022 A * 5/1927 Davis et al. ..... 166/95.1
1,935,027 A * 11/1933 Heggem ..... 166/89.1
2,104,270 A * 1/1938 Owsley ..... 166/285
2,223,509 A 12/1940 Brauer (Continued)

FOREIGN PATENT DOCUMENTS

EP 0 419 281 A2 3/1991

(Continued)

OTHER PUBLICATIONS

Foreign Communication From a Related Counter Part Application, Jan. 8, 2007.

(Continued)

*Primary Examiner*—David Bagnell
*Assistant Examiner*—Robert Fuller
(74) *Attorney, Agent, or Firm*—John W. Wustenberg; Baker Botts, L.L.P.

(57) ABSTRACT

The present invention is directed to an apparatus and method for reverse circulation cementing a casing in an open-hole wellbore. The apparatus includes a surface pack-off device, which has a housing defined by an upper section and lower section. A load bearing plate is secured to the housing between the upper and lower sections. The load plate and lower section of the housing cooperate to prevent sloughing of the earth at the surface of the wellbore via a section of casing string. The surface pack-off device also includes a casing hanger, which couples to the casing in the wellbore. Fluid inlets allow the cement to be pumped into the wellbore in the annulus formed between the casing and wellbore sidewall. The method includes the steps of installing the surface pack-off device and operation on reverse circulation of the cement down the annulus.

19 Claims, 6 Drawing Sheets

U.S. PATENT DOCUMENTS

| | | | | |
|---|---|---|---|---|
| 2,230,589 | A | 2/1941 | Driscoll | |
| 2,407,010 | A | 9/1946 | Hudson | |
| 2,472,466 | A | 6/1949 | Counts et al. | |
| 2,647,727 | A | 8/1953 | Edwards | 255/28 |
| 2,675,082 | A | 4/1954 | Hall | 166/22 |
| 2,849,213 | A | 8/1958 | Failing | |
| 2,919,709 | A | 1/1960 | Schwegman | 137/68 |
| 3,051,246 | A | 8/1962 | Clark, Jr. et al. | 166/226 |
| 3,193,010 | A | 7/1965 | Bielstien | |
| 3,277,962 | A | 10/1966 | Flickinger et al. | 166/15 |
| 3,948,322 | A | 4/1976 | Baker | 166/289 |
| 3,948,588 | A | 4/1976 | Curington et al. | |
| 3,951,208 | A | 4/1976 | Delano | 166/78 |
| 4,105,069 | A | 8/1978 | Baker | 166/51 |
| 4,271,916 | A | 6/1981 | Williams | |
| 4,300,633 | A | 11/1981 | Stewart | |
| RE31,190 | E | 3/1983 | Detroit et al. | |
| 4,469,174 | A | 9/1984 | Freeman | |
| 4,519,452 | A | 5/1985 | Tsao et al. | |
| 4,531,583 | A | 7/1985 | Revett | |
| 4,548,271 | A | 10/1985 | Keller | 166/291 |
| 4,555,269 | A | 11/1985 | Rao et al. | |
| 4,671,356 | A | 6/1987 | Barker et al. | |
| 4,676,832 | A | 6/1987 | Childs et al. | |
| 4,791,988 | A | 12/1988 | Trevillion | |
| 4,917,184 | A * | 4/1990 | Freeman et al. | 166/285 |
| 4,961,465 | A | 10/1990 | Brandell | |
| 5,024,273 | A | 6/1991 | Coone et al. | 166/289 |
| 5,117,910 | A | 6/1992 | Brandell et al. | |
| 5,125,455 | A | 6/1992 | Harris et al. | |
| 5,133,409 | A | 7/1992 | Bour et al. | |
| 5,147,565 | A | 9/1992 | Bour et al. | |
| 5,188,176 | A | 2/1993 | Carpenter | |
| 5,213,161 | A | 5/1993 | King et al. | |
| 5,273,112 | A | 12/1993 | Schultz | 166/374 |
| 5,297,634 | A | 3/1994 | Loughlin | 166/387 |
| 5,318,118 | A | 6/1994 | Duell | |
| 5,323,858 | A | 6/1994 | Jones et al. | |
| 5,361,842 | A | 11/1994 | Hale et al. | |
| 5,484,019 | A | 1/1996 | Griffith | |
| 5,494,107 | A | 2/1996 | Bode | 166/285 |
| 5,507,345 | A | 4/1996 | Wehunt, Jr. et al. | 166/285 |
| 5,559,086 | A | 9/1996 | Dewprashad et al. | |
| 5,571,281 | A | 11/1996 | Allen | 366/2 |
| 5,577,865 | A | 11/1996 | Manrique et al. | |
| 5,641,021 | A | 6/1997 | Murray et al. | 166/291 |
| 5,647,434 | A | 7/1997 | Sullaway et al. | 166/242.8 |
| 5,671,809 | A | 9/1997 | McKinzie | |
| 5,718,292 | A | 2/1998 | Heathman et al. | |
| 5,738,171 | A | 4/1998 | Szarka | |
| 5,749,418 | A | 5/1998 | Mehta et al. | |
| 5,762,139 | A | 6/1998 | Sullaway et al. | |
| 5,803,168 | A | 9/1998 | Lormand et al. | 166/77.2 |
| 5,829,526 | A | 11/1998 | Rogers et al. | 166/291 |
| 5,875,844 | A | 3/1999 | Chatterji et al. | |
| 5,890,538 | A | 4/1999 | Beirute et al. | 166/285 |
| 5,897,699 | A | 4/1999 | Chatterji et al. | |
| 5,900,053 | A | 5/1999 | Brothers et al. | |
| 5,913,364 | A | 6/1999 | Sweatman | |
| 5,968,255 | A | 10/1999 | Mehta et al. | |
| 5,972,103 | A | 10/1999 | Mehta et al. | |
| 6,060,434 | A | 5/2000 | Sweatman et al. | |
| 6,063,738 | A | 5/2000 | Chatterji et al. | |
| 6,098,710 | A | 8/2000 | Rhein-Knudsen et al. | 166/285 |
| 6,138,759 | A | 10/2000 | Chatterji et al. | |
| 6,143,069 | A | 11/2000 | Brothers et al. | |
| 6,167,967 | B1 | 1/2001 | Sweatman | |
| 6,196,311 | B1 | 3/2001 | Treece et al. | |
| 6,204,214 | B1 | 3/2001 | Singh et al. | |
| 6,244,342 | B1 | 6/2001 | Sullaway et al. | 166/285 |
| 6,258,757 | B1 | 7/2001 | Sweatman et al. | |
| 6,311,775 | B1 | 11/2001 | Allamon et al. | 166/285 |
| 6,318,472 | B1 | 11/2001 | Rogers et al. | 166/382 |
| 6,367,550 | B1 | 4/2002 | Chatterji et al. | |
| 6,431,282 | B1 | 8/2002 | Bosma et al. | |
| 6,454,001 | B1 | 9/2002 | Thompson et al. | |
| 6,457,524 | B1 | 10/2002 | Roddy | |
| 6,467,546 | B2 | 10/2002 | Allamon et al. | 166/381 |
| 6,481,494 | B1 | 11/2002 | Dusterhoft et al. | 166/51 |
| 6,484,804 | B2 | 11/2002 | Allamon et al. | 166/291 |
| 6,488,088 | B1 | 12/2002 | Kohli et al. | |
| 6,488,089 | B1 | 12/2002 | Bour et al. | |
| 6,488,763 | B2 | 12/2002 | Brothers et al. | |
| 6,540,022 | B2 | 4/2003 | Dusterhoft et al. | 166/278 |
| 6,622,798 | B1 | 9/2003 | Rogers et al. | 166/380 |
| 6,666,266 | B2 | 12/2003 | Starr et al. | 166/90.1 |
| 6,732,797 | B1 | 5/2004 | Watters et al. | 166/291 |
| 6,758,281 | B2 | 7/2004 | Sullaway et al. | 166/386 |
| 6,802,374 | B2 | 10/2004 | Edgar et al. | |
| 6,808,024 | B2 | 10/2004 | Schwendemann et al. | 166/387 |
| 6,810,958 | B2 | 11/2004 | Szarka et al. | 166/285 |
| 2003/0000704 | A1 | 1/2003 | Reynolds | |
| 2003/0029611 | A1 | 2/2003 | Owens | |
| 2003/0072208 | A1 | 4/2003 | Rondeau et al. | 366/16 |
| 2003/0192695 | A1 | 10/2003 | Dillenbeck et al. | |
| 2004/0079553 | A1 | 4/2004 | Livingstone | |
| 2004/0084182 | A1 | 5/2004 | Edgar et al. | |
| 2004/0099413 | A1 | 5/2004 | Arceneaux | |
| 2004/0104050 | A1 | 6/2004 | Järvelä et al. | |
| 2004/0104052 | A1 | 6/2004 | Livingstone | |
| 2004/0177962 | A1 | 9/2004 | Bour | |
| 2004/0231846 | A1 | 11/2004 | Griffith et al. | 166/291 |
| 2005/0061546 | A1 | 3/2005 | Hannegan | |
| 2005/0183857 | A1 * | 8/2005 | Rogers et al. | 166/90.1 |
| 2006/0016599 | A1 | 1/2006 | Badalamenti et al. | 166/285 |
| 2006/0016600 | A1 | 1/2006 | Badalamenti et al. | 166/285 |
| 2006/0042798 | A1 | 3/2006 | Badalamenti et al. | 166/285 |
| 2006/0076135 | A1 | 4/2006 | Rogers et al. | 166/285 |
| 2006/0086499 | A1 | 4/2006 | Badalamenti et al. | 166/250.14 |
| 2006/0086502 | A1 | 4/2006 | Reddy et al. | 166/291 |
| 2006/0086503 | A1 | 4/2006 | Reddy et al. | 166/293 |

FOREIGN PATENT DOCUMENTS

| | | |
|---|---|---|
| GB | 2193741 | 2/1988 |
| GB | 2 327 442 A | 1/1999 |
| GB | 2327442 | 11/1999 |
| GB | 2 348 828 A | 10/2000 |
| RU | 1716096 A1 | 2/1992 |
| RU | 1723309 A1 | 3/1992 |
| RU | 1758211 | 8/1992 |
| RU | 1774986 | 11/1992 |
| RU | 1778274 | 11/1992 |
| RU | 2067158 | 9/1996 |
| RU | 2 086 752 | 8/1997 |
| SU | 571584 | 9/1977 |
| SU | 1 542 143 | 12/1984 |
| SU | 1420139 | 8/1988 |
| SU | 1534183 | 1/1990 |
| WO | WO 2004/104366 | 12/2004 |
| WO | WO 2005/083229 A1 | 9/2005 |
| WO | WO 2006/008490 A1 | 1/2006 |
| WO | WO 2006/064184 A1 | 6/2006 |

OTHER PUBLICATIONS

Foreign communication From a Related Counter Part Application, Jan. 17, 2007.

SPE 25540 entitled "Evaluation of the Effects of Mutliples In Seismic Data From the Gulf Using Vertical Seismic Profiles" by Andrew Fryer, dated 1993.

SPE 29470 entitled "Monitoring Circulatable Hole with Real-Time Correction: Case Histories" by James E. Griffith, dated 1995.

IADC-SPE 35081 entitled "Drill-Cutting Removal in a Horizontal Wellbore For Cementing" by Krishna M. Ravi, dated 1996.

SPE/IADC 79907 entitled "Advances in Tieback Cementing" by Douglas P. MacEachern et al., dated 2003.
IADC/SPE 87197 entitled "Reverse Circulation of Primary Cementing Jobs—Evaluation and Case History" by Jason Davies et al., dated 2004.
Griffith, et al., "Reverse Circulation of Cement on Primary Jobs Increases Cement Column Height Across Weak Formations," Society of Petroleum Engineers, SPE 25440, 315-319, Mar. 22-23, 1993.
Filippov, et al., "Expandable Tubular Solutions," Society of Petroleum Engineers, SPE 56500, Oct. 3-6, 1999.
Daigle, et al., "Expandable Tubulars: Field Examples of Application in Well Construction and Remediation," Society of Petroleum Engineers, SPE 62958, Oct. 1-4, 2000.
Carpenter, et al., "Remediating Sustained Casing Pressure by Forming a Downhole Annular Seal with Low-Melt-Point Eutectic Metal," IADC/SPE 87198, Mar. 2-4, 2004.
Halliburton Casing Sales Manual, Section 4, Cementing Plugs, pp. 4-29 and 4-30, Oct. 6, 1993.
G.L. Cales, "The Development and Applications of Solid Expandable Tubular Technology," Paper No. 2003-136, Petroleum Society's Canadian International Petroleum Conference 2003, Jun. 10-12, 2003.
Gonzales, et al., "Increasing Effective Fracture Gradients by Managing Wellbore Temperatures," IADC/SPE 87217, Mar. 2-4, 2004.
MacEachern, et al., "Advances in Tieback Cementing," IADC/SPE 79907, 2003.
Davies, et al, "Reverse Circulation of Primary Cementing Jobs—Evaluation and Case History," IADC/SPE 87197, Mar. 2-4, 2004.
Abstract No. XP-002283587, "Casing String Reverse Cemented Unit Enhance Efficiency Hollow Pusher Housing", Aug. 30, 1992.
Abstract No. XP-002283586, "Reverse Cemented Casing String Reduce Effect Intermediate Layer Mix Cement Slurry Drill Mud Quality Lower Section Cement Lining", Aug. 30, 1988.
Brochure, Enventure Global Technology, "Expandable-Tubular Technology," pp. 1-6, 1999.
Dupal, et al, "Solid Expandable Tubular Technology—A Year of Case Histories in the Drilling Environment," SPE/IADC 67770, Feb. 27-Mar. 1, 2001.
DeMong, et al., "Planning the Well Construction Process for the Use of Solid Expandable Casing," SPE/IADC 85303, Oct. 20-22, 2003.
Waddell, et al., "Installation of Solid Expandable Tubular Systems Through Milled Casing Windows," IADC/SPE 87208, Mar. 2-4, 2004.
DeMong, et al., "Breakthroughs Using Solid Expandable Tubulars to Construct Extended Reach Wells," IADC/SPE 87209, Mar. 2-4, 2004.
Escobar, et al., "Increasing Solid Expandable Tubular Technology Reliability in a Myriad of Downhole Environments," SPE 81094, Apr. 27-30, 2003.
Foreing Communication from a Related Counter Part Application, Oct. 12, 2005.
Foreign Communication from a Related Counter Part Application, Sep. 30, 2005.
Foreign Communication from a Related Counter Part Application, Dec. 7, 2005.
Halliburton Brochure entitled "Bentonite (Halliburton Gel) Viscosifier", 1999.
Halliburton Brochure entitled "Cal-Seal 60 Cement Accelerator", 1999.
Halliburton Brochure entitled "Diacel D Lightweight Cement Additive", 1999.
Halliburton Brochure entitled "Cementing Flex-Plug® OBM Lost-Circulation Material", 2004.
Halliburton Brochure entitled "Cementing FlexPlug® W Lost-Circulation Material", 2004.
Halliburton Brochure entitled "Gilsonite Lost-Circulation Additive", 1999.
Halliburton Brochure entitled "Micro Fly Ash Cement Component", 1999.
Halliburton Brochure entitled "Silicalite Cement Additive", 1999.
Halliburton Brochure entitled "Spherelite Cement Additive", 1999.
Halliburton Brochure entitled "Increased Integrity With the StrataLock Stabilization System", 1998.
Halliburton Brochure entitled "Perlite Cement Additive", 1999.
Halliburton Brochure entitled "The PermSeal System Versatile, Cost-Effective Sealants for Conformance Applications", 2002.
Halliburton Brochure entitled "Pozmix® A Cement Additive", 1999.
Foreign Communication from a Related Counter Part Application, Dec. 9, 2005.
Foreign Communication from a Related Counter Part Application, Feb. 24, 2005.
R. Marquaire et al., "Primary Cementing by Reverse Circulation Solves Critical Problem in the North Hassi-Messaoud Field, Algeria", SPE 1111, Feb. 1966.
Foreign Communication from a Related Counter Part Application, Dec. 27, 2005.
Foreign Communication from a Related Counter Part Application, Feb. 23, 2006.

* cited by examiner

APPARATUS AND METHOD FOR REVERSE CIRCULATION CEMENTING A CASING IN AN OPEN-HOLE WELLBORE

BACKGROUND

The present invention relates generally to apparatuses and methods for cementing tubing or casing in downhole environments, and more particularly to an apparatus and method for reverse circulation cementing a casing in an open-hole wellbore.

During downhole cementing operations, fluid circulation is generally performed by pumping down the inside of the tubing or casing and then back up the annular space around the casing. This type of circulation has been used successfully for many years. However, it has several drawbacks. First, the pressures required to "lift" the cement up into the annular space around the casing can sometimes damage the formation. Furthermore, it takes a fair amount of time to deliver the fluid to the annular space around the casing in this fashion.

In an effort to decrease the pressures exerted on the formation and to reduce pump time requirements, a solution involving pumping the fluid down the annular space of the casing rather than down the casing itself has been proposed. This technique, known as reverse circulation, requires lower delivery pressures, because the cement does not have to be lifted up the annulus. Furthermore, the reverse circulation technique is less time consuming than the conventional method because the fluid is delivered down the annulus only, rather than down the inside of the casing and back up the annulus. Accordingly, the cement travels approximately half the distance with this technique.

There are a number of drawbacks of current reverse circulation methods and devices, however. Such methods require a wellhead or other conventional surface pack-off to be attached to the surface casing that is sealably attached to the casing being cemented in place via the reverse circulation technique. These structures are often complex, permanent and expensive, thus increasing the cost of completing the well.

Furthermore, in some applications, reverse circulation techniques are not even available in the first instance, because there is no access to the annulus from outside the system to pump the cement down the annulus. Such systems include open-hole wells in which casing pipe has been suspended by elevators that rest on boards, such as railroad ties or other similar supports. The problem with these inexpensive well designs is that the elevators and supports block access to the annulus, so it is not possible to employ reverse circulation techniques on them. Such applications are therefore necessarily limited to traditional cementing techniques, i.e., pumping the cement down the casing and back up the annulus. Such applications are therefore susceptible to all of the drawbacks of traditional cementing techniques.

SUMMARY

The present invention is directed to a surface pack-off device, which attaches between the wellbore sidewall and casing that allows for reverse circulation down the annulus formed between the casing to be cemented and the wellbore sidewall.

More specifically, the present invention is directed to a surface pack-off device for reverse circulation cementing a casing to an open-hole wellbore, comprising: a housing having an upper section and a lower section; a load plate secured to the housing between the upper section and the lower section; at least one fluid inlet formed in the upper section of the housing; and a casing hanger adapted to fit within the upper section of the housing. The casing hanger connects to a section of casing string, which in turn connects to the casing string installed in the wellbore. An annulus is formed between an inside surface of the housing and the casing suspended from the casing hanger. It is through this void that the cement is pumped downhole. The cement composition enters the annulus through the at least one fluid inlet. In one embodiment, the surface pack-off device is removable. In this embodiment, the upper section of the housing is detachable from the lower section of the housing and a split casing ring is provided to enable the upper section of the housing to be removed. In another embodiment it is designed to be a permanent structure secured at the opening of the wellbore.

In another aspect, the present invention is directed to a method of reverse circulation cementing a casing in an open-hole wellbore. The method comprises the steps of: installing the casing into the open-hole wellbore; installing the pack-off device at a surface opening of the open-hole wellbore, wherein a lower portion of the housing and the load plate cooperate to prevent collapse of the wellbore at the surface; connecting the casing string to the casing hanger; and pumping cement down the annulus.

The features and advantages of the present invention will be readily apparent to those skilled in the art upon a reading of the description of the exemplary embodiments, which follows.

BRIEF DESCRIPTION OF THE DRAWINGS

A more complete understanding of the present disclosure and advantages thereof may be acquired by referring to the following description taken in conjunction with the accompanying drawings, which.

DETAILED DESCRIPTION

Figure 1:
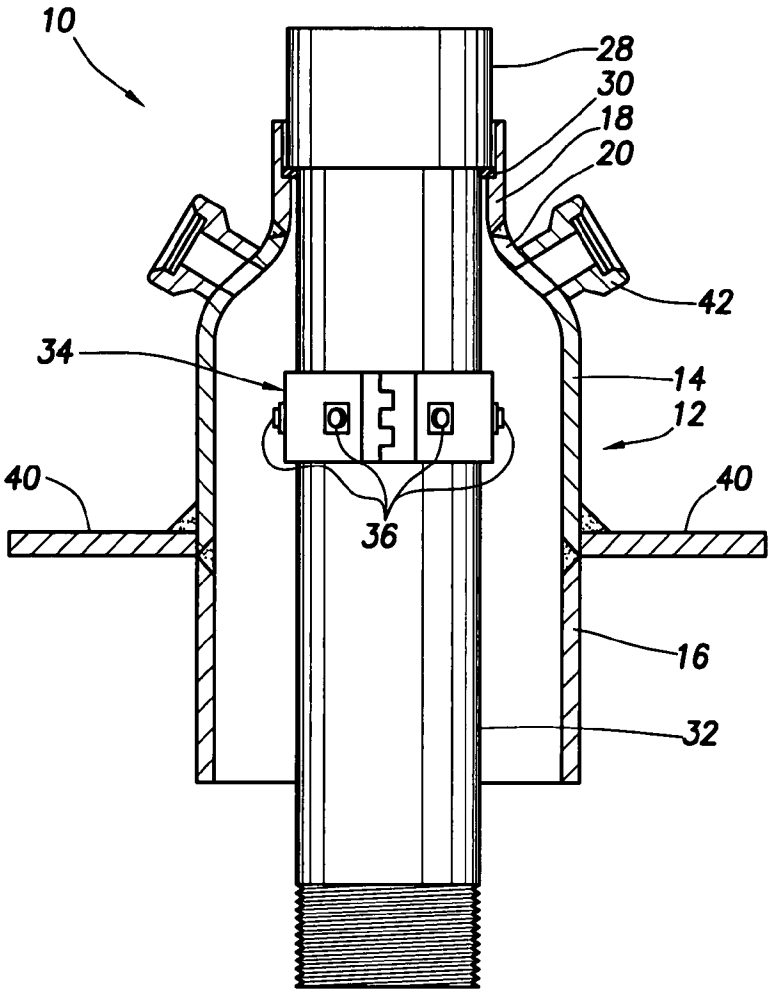
FIG. 1 is a schematic diagram of one embodiment of a surface pack-off device in accordance with the present invention.

The details of the present invention will now be described with reference to the accompanying drawings. Turning to FIG. 1, a surface pack-off device in accordance with the present invention is shown generally by reference numeral 10. The surface pack-off device 10 includes a housing 12, which is generally cylindrical in shape. The housing 12 is defined by an upper section 14 and lower section 16. The upper section 14 narrows at its top forming a neck 18 and shoulder 20 therebetween.

Figure 8:
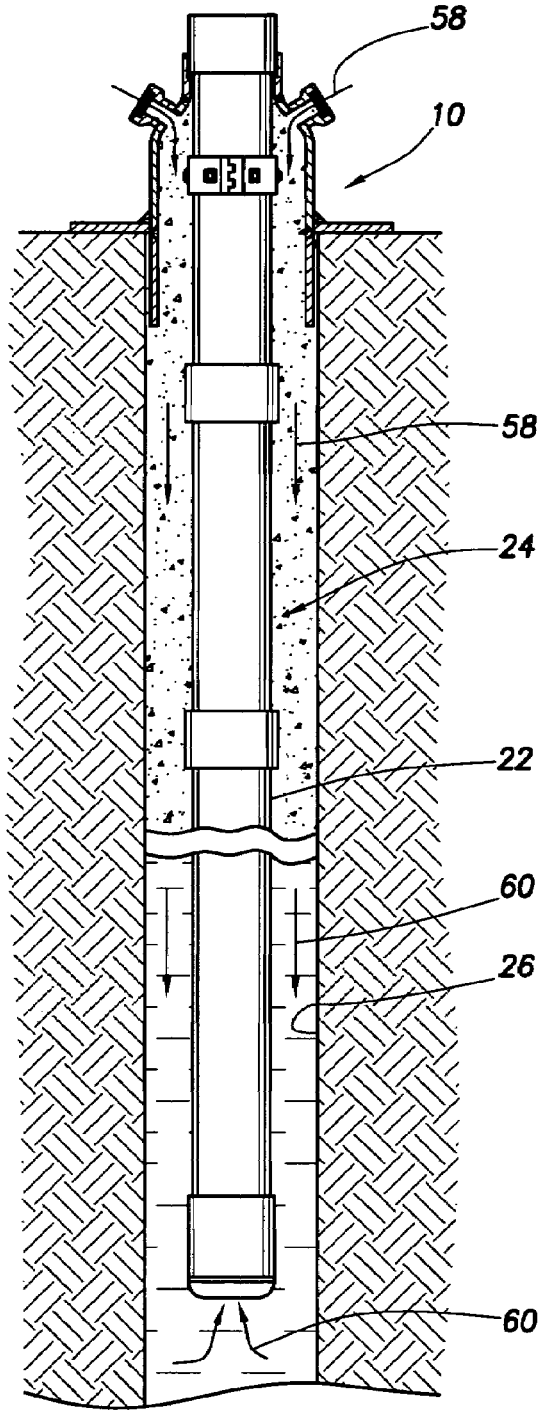
FIG. 8 illustrates the step of pumping a cement composition down the annulus between the casing and wellbore sidewall using the surface pack-off device of FIG. 1 in accordance with the reverse circulation technique of the present invention.

The housing 12 is designed to fit over and attach to a casing string 22 (shown in FIG. 8), which is the casing to be cemented. An annulus 24 is formed between the casing string 22 and wellbore sidewall 26, as shown in FIG. 8. Cement is pumped into the annulus 24 through the surface pack-off device 10 to secure the casing string 22 to the wellbore sidewall 26.

Figure 2:
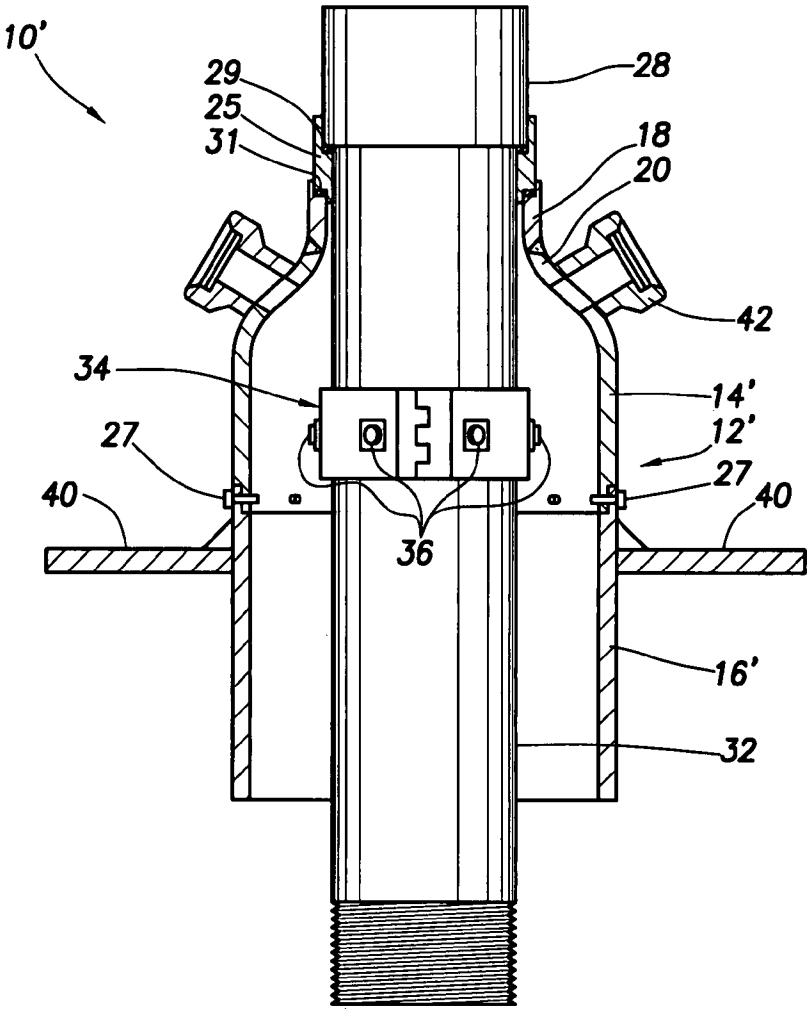
FIG. 2 is a schematic diagram of another embodiment of a surface pack-off device in accordance with the present invention.

The housing 12 of the surface pack-off device 10 in accordance with the present invention may be formed, e.g., by casting, as one piece, as shown in FIG. 1, or multiple pieces, as shown in FIG. 2. The surface pack-off device 10 of FIG. 1 is designed to be a permanent structure and therefore can serve as an inexpensive wellhead for the well. The upper section 14 of the surface pack-off device 10' of FIG. 2 is designed to be removable and therefore reusable in other wells. In the embodiment of FIG. 2, the upper section 14' of the housing 12' fits within a recess formed in the lower section 16' and is held in place by a plurality of pins 27, which can easily be removed when it is desired to remove the upper half of the surface pack-off device 10' for later reuse. As those of ordinary skill in the art will appreciate, the design can be such that the lower section 16' sits in a recess formed in the upper section 14', i.e., the reverse of what is shown in FIG. 2. Also, other means of attaching the upper section 14' of the housing 12' to the lower section 16' now known or later developed may be employed. In one exemplary embodiment, the housing 12 of the surface pack-off device 10 in accordance with the present invention is formed of a ferrous metal similar to that which is used to make the pipe forming casing string 22.

The surface pack-off device 10 further comprises a casing hanger 28, which is adapted to fit within a recess formed in the neck portion 18 of the housing 12. As those of ordinary skill in the art will appreciate, the casing hanger 28 can take many forms. In one exemplary embodiment, the casing hanger 28 is a simple threaded coupling. The casing hanger 28 sits on a flexible disc 30 formed of a material such as rubber, an elastomer, or a metal having a high modulus of elasticity, which seals the casing hanger 28 against the neck portion 18 of the housing 12. The flexible disc 30 prevents leakage of the cement composition out of the surface pack-off device 10 during the reverse circulation cementing operation.

The embodiment of FIG. 2 further includes a split casing ring 25 which fits within a recess in neck portion 18. The split casing ring 25 is formed into two or more arcuate shaped members which are detachable from an outer surface. The split casing ring 25 has an upper and lower recess. The upper recess is adapted to receive and support casing hanger 28. A flexible disc 29 sits between the upper recess of the split casing ring 25 and the casing hanger 28. Another flexible disc 31 sits between the lower recess of the split casing ring 25 and the recess in neck portion 18. The flexible discs 29 and 31 can be formed of a material, such as rubber, an elastomer, or a metal having a high modulus of elasticity. The flexible discs 29 and 31 prevent leakage of the surface pack-off device 10' during the reverse circulation cementing operations. The split casing ring 25 enables the upper section 14' of the housing 12' to be removed after the cementing job is complete as described more fully below with reference to FIGS. 9-11.

The surface pack-off device 10 further comprises a section of casing string 32, which couples to, and is suspended from, the casing hanger 28. In one exemplary embodiment, the section of casing string 32 is threaded at both ends and mates with the casing hanger 28 via a threaded connection. In such an embodiment, the casing hanger 28 is fitted with a female thread and the section of casing string 32 is fitted with a male thread. However, as those of ordinary skill will appreciate, the exact form of the connection between these two components is not critical to the invention. The section of casing string 32 is adapted to mate with the casing string 22 at the end opposite that suspended from the casing hanger 28. Again, although a threaded connection is illustrated as the means for joining these components, other means of joining these components may be employed.

The surface pack-off device 10 further comprises a limit clamp 34, which in one exemplary embodiment is formed in two half-sections hinged together. In another embodiment, the limit clamp 34 may be formed as a unitary ring that is capable of slipping onto the outer circumferential surface of the casing string 32. The limit clamp 34 is secured around the outer circumferential surface of the section of casing string 32 with a plurality of bolts 36 or other similar securing means and functions to prevent the section of casing string 32 from being pulled out of the housing 12. More specifically, the limit clamp 34 enables the surface pack-off device 10 to be transported by a handling sub 38, as described further below.

The surface pack-off device 10 further includes a load plate 40, which is secured, e.g., by welding or brazing, to the outer surface of the housing 12 between the upper section 14 and the lower section 16. The load plate 40 is generally washer-shaped; although it may have another configuration. In one exemplary embodiment, the load plate 40 has an inner diameter of about 1 ft, which approximates the outer diameter of the housing 12, and an outer diameter of about 3 ft. The load plate 40 is provided to carry the weight of the casing string 22 being cemented to the wellbore sidewall 26. It also eliminates the need for a rig to remain over the well during cementing. Additionally, the load plate 40 eliminates the need for conventional retention methods such as elevators and boards, such as railroad ties. Furthermore, the combination of the load plate 40 and the lower section 16 of the housing 12 prevents the wellbore from sloughing due to the weight of the casing being exerted on the earth near the opening of the wellbore 1. As those of ordinary skill in the art will appreciate, the dimensions of load plate 40 may vary depending upon the overall dimensions of the wellbore being cased.

The surface pack-off device 10 further comprises a plurality of fluid inlets 42 attached to the housing 12 in the shoulder section 20. The fluid inlets 42 pass fluids, e.g., cement, from outside of the well into annulus 24. In one exemplary embodiment, the surface pack-off device 10 has four fluid inlets 42, equally spaced around the circumference of the housing 12. Each fluid inlet 42 is adapted to couple the surface pack-off device 10 to a fluid supply line (not shown), so that fluid can be injected into annulus 24. In one exemplary embodiment, the fluid inlets 42 are a Weco Model No. 1502 fluid inlet. As those of ordinary skill in the art will appreciate, the exact number, size and spacing of the fluid passages may be varied depending upon a number of factors, including, the amount of fluid needed to be delivered and the desired rate at which the fluid is to be delivered.

Figure 3:
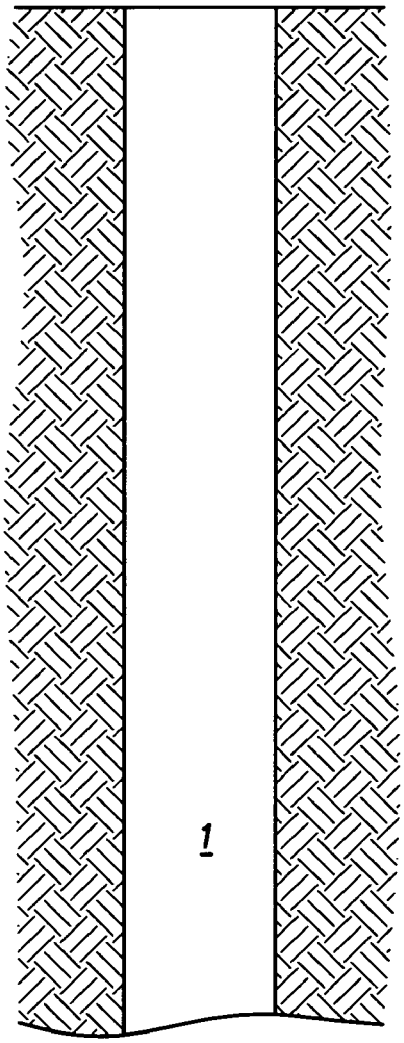
FIG. 3 illustrates the step of drilling a wellbore in accordance with the reverse circulation cementing technique of the present invention.
Figure 4:
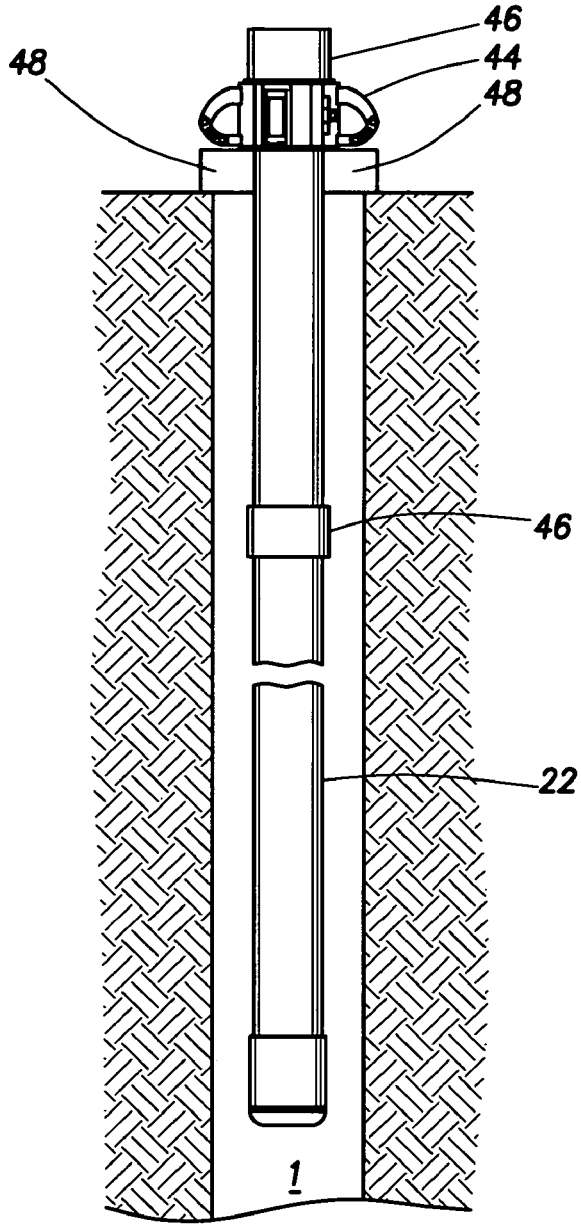
FIG. 4 illustrates the step of suspending a casing from elevators into the wellbore of FIG. 4 in accordance with the reverse circulation cementing technique of the present invention.
Figure 5:
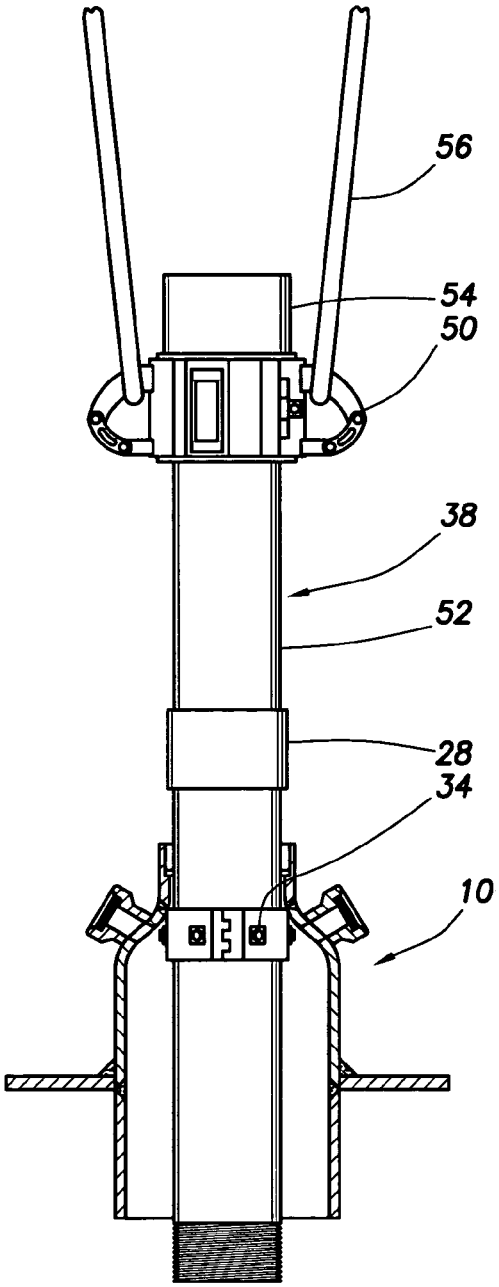
FIG. 5 illustrates the step of lifting the surface pack-off device of FIG. 1 with a handling sub prior to stabbing the suspended casing of FIG. 4 with the surface pack-off device in accordance with the reverse circulation cementing technique of the present invention.

In another aspect, the present invention is directed to a method of reverse circulation cementing a casing string 22 in an open-hole wellbore, which employs the surface pack-off device 10. In the first phase of the method, wellbore 1 is drilled in subterranean formation 2, as illustrated in FIG. 3, and the casing string 22 is installed in the wellbore 1, as illustrated in FIG. 4. The wellbore 1 can be drilled using any conventional technique. For example, a drilling rig (not shown) can be used to drill wellbore 1. Once the wellbore 1 has been drilled, the casing string 22 is installed into the wellbore 1 using a conventional drilling rig or other similar device. During this step in the process, sections of the casing string 22 are lowered into the wellbore 1 using elevators 44 or some other similar device. Adjacent sections of the casing string 22 are joined using simple threaded couplings 46. Once the entire length of casing string 22 has been lowered into the wellbore 1 by the drilling rig or other such device, the elevators 44 are lowered onto support members 48, e.g., a pair of railroad ties, until the surface pack-off device 10 is ready to be installed at the surface of the wellbore 1.

Figure 6:
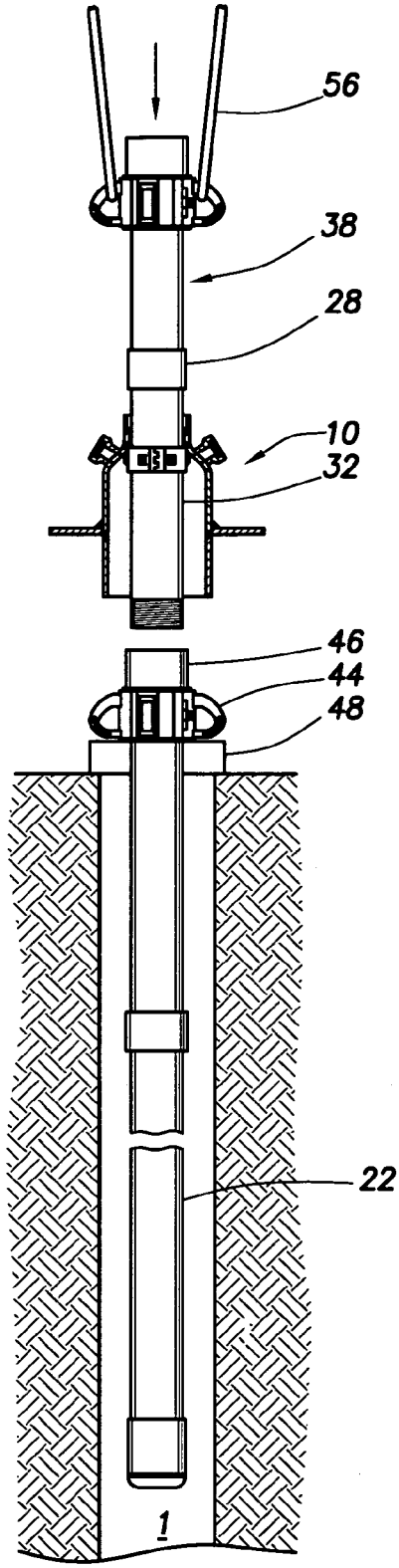
FIG. 6 illustrates the step of stabbing the suspended casing with the surface pack-off device in accordance with the reverse circulation cementing technique of the present invention.

In the next phase of the method, the surface pack-off device 10 is stabbed into the hanging casing 22 using handling sub 38. The handling sub 38 is then removed and the surface pack-off device 10 is ready for reverse circulation. In describing this part of the process, reference is made to FIGS. 5-8. In the first step in this part of the process, the handling sub 38 is coupled to the surface pack-off device 10. The handling sub 38 comprises elevators 50 clamped around threaded pipe 52, which is in turn connected to threaded coupling 54. Coupling of the handling sub 38 to the surface pack-off device is accomplished by threading threaded pipe 52 to the casing hanger 28. Once the handling sub 38 has been coupled to the surface pack-off device 10, the surface pack-off device can be lifted off of the surface from which it had been set on initial delivery to the well site. This is accomplished by aid of a workover rig (not shown), which lifts the assembly via one or more suspension bales 56 secured to elevators 50. As shown in FIG. 6, the limit clamp 34 operates to retain the section of casing string 32 within the housing 12 and through abutment against the shoulder 20 operates to carry the housing 12. The workover rig then stabs the surface pack-off device 10 into the casing string 22 suspended by elevators 44 and support members 48, as shown in FIG. 6. During this step, the well operator connects section of casing string 32 to threaded coupling 46. Once this connection is made, the elevators 44 can be unclamped from casing string 22 and the support members 48 removed. The surface pack-off device 10 can then be landed onto the opening of the wellbore 1.

Figure 7:
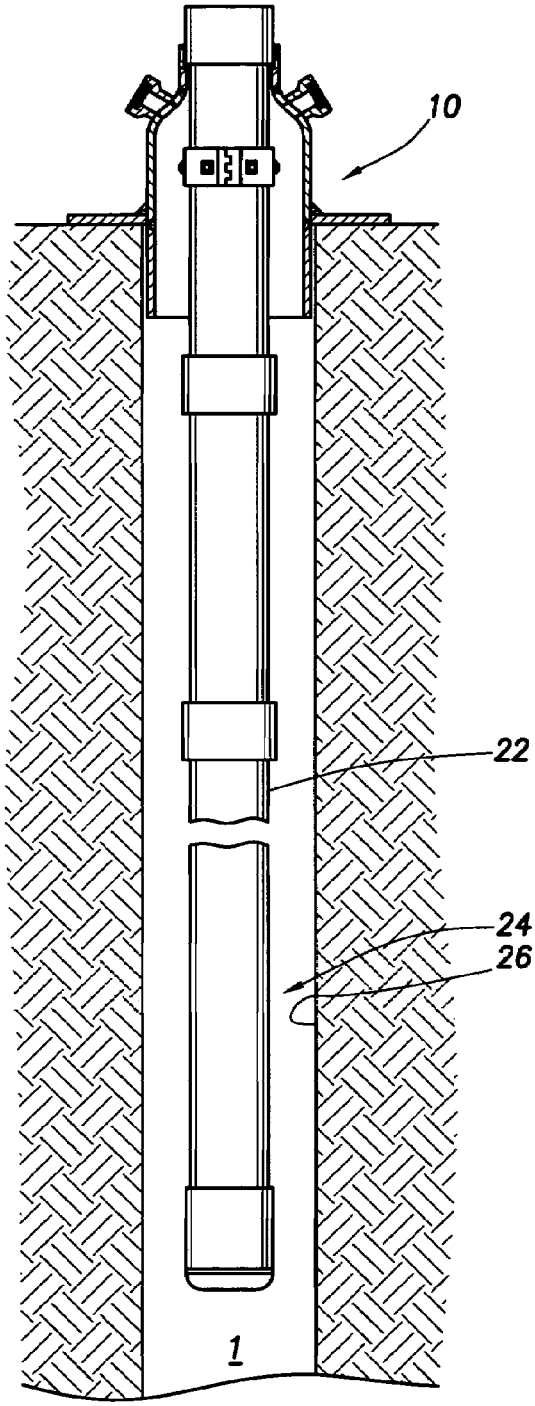
FIG. 7 illustrates the state of the well after the surface pack-off device has been stabbed into the suspended casing and the handling sub has been removed in accordance with the reverse circulation cementing technique of the present invention.

In the embodiment of FIG. 1 where the surface pack-off device 10 remains permanently in the wellbore 1, the handling sub 38 is decoupled from the surface pack-off device 10 by unthreading threaded pipe 52 from casing hanger 28. The handling sub 38 can then be lifted away from the well site. FIG. 7 illustrates the surface pack-off device 10 stabbed into the suspended casing string 22 with the elevators 44, support members 48 and handling sub 38 removed.

In the last phase of the method, a cement composition 58 is pumped downhole through the annulus 24 between the casing string 22 and wellbore sidewall 26 as indicated by the arrows in FIG. 8. This is accomplished first by connecting a tank containing the cement composition (not shown) to the fluid inlets 42 via a plurality of conduits or hoses (also not shown). Positive displacement pumps or other similar devices (not shown) can then be used to pump the cement composition 58 into the well. As pointed about above, by pumping the cement 58 down the annulus 24 rather than up through the casing string 22, it takes approximately half the time to fill the annulus 24 with cement and less pump pressure, since there is no need to lift the cement 58 up the annulus 24. As also shown, the drilling mud, debris and other contents in the wellbore can be recovered back up the casing string 22, as indicated by the arrows labeled 60 in FIG. 8. Although this involves lifting fluids back up the wellbore, because the mud, debris and other contents of the well 60 are typically lighter than the cement 58, not as much pump pressure is required.

Figure 9:
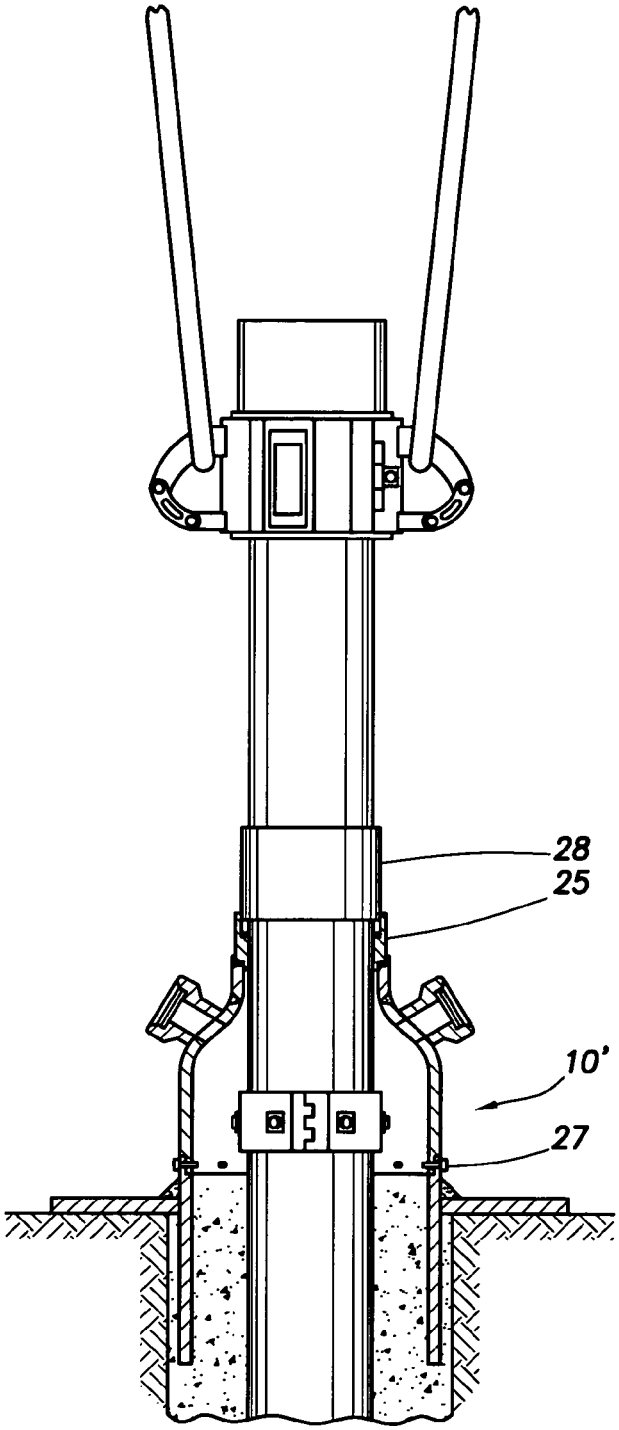
FIGS. 9-11 illustrate the steps of removing the upper section of the housing of the surface pack-off device from the lower section of the housing of the surface pack-off device after the cementing job has been completed.
Figure 10:
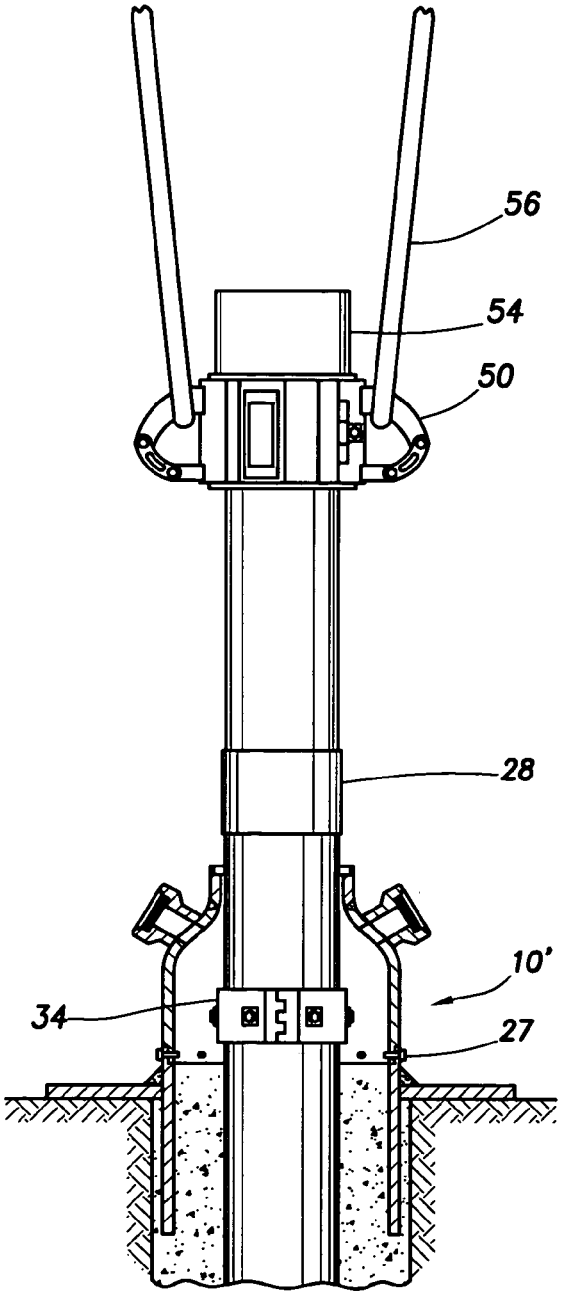
Figure 11:
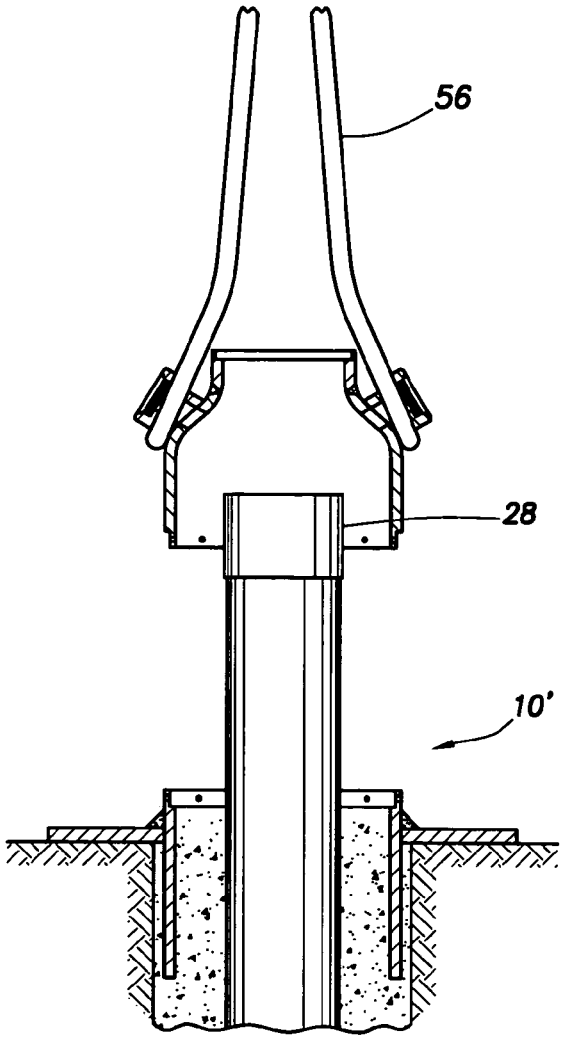

After the cement 58 has set, the surface pack-off device 10 can optionally be left in place and thus serve as a permanent wellhead, or it can be removed, if, e.g., the embodiment of the surface pack-off device 10' illustrated in FIG. 2 is employed. If the surface pack-off device 10' is to be removed, the step of decoupling the threaded pipe 52 from the casing hanger 28 is not carried out until after the cement job is completed. Rather, after the cement job is completed, the handling sub 38 is lifted upward by the rig by pulling on bales 56. This causes the casing hanger 28 to be lifted off of the split casing ring 25 and associated flexible disc 30, as shown in FIG. 9. Once the casing hanger 28 has been lifted off of the split casing ring 25, the split casing ring can be removed. Next, the threaded pipe 52 can be decoupled from the casing hanger 28 (shown in FIG. 10) and the pins 27, which secure the upper section 14' of the surface pack-off device 10' to the lower section 16' of the pack-off device 10' can be removed. Finally, the workover rig can then lift the upper section of the surface pack-off device 10' off of the well using bales 56, as shown in FIG. 11, and place it on a transport vehicle (not shown) for subsequent use. Also, if a hinged limit clamp 34 is used, it can be removed and reused. The benefit of the surface pack-off device 10' is that all of the components, except for the lower section 16', the section of casing pipe 32, and load plate 40', can be salvaged for reuse, thereby making the surface pack-off device 10' essentially reusable.

Therefore, the present invention is well-adapted to carry out the objects and attain the ends and advantages mentioned as well as those which are inherent therein. While the invention has been depicted, described, and is defined by reference to exemplary embodiments of the invention, such a reference does not imply a limitation on the invention, and no such limitation is to be inferred. The invention is capable of considerable modification, alteration, and equivalents in form and function, as will occur to those ordinarily skilled in the pertinent arts and having the benefit of this disclosure. The depicted and described embodiments of the invention are exemplary only, and are not exhaustive of the scope of the invention. Consequently, the invention is intended to be limited only by the spirit and scope of the appended claims, giving full cognizance to equivalents in all respects.

What is claimed is:

1. An apparatus for reverse circulation cementing a casing to an open-hole wellbore, comprising:

a housing defined by a generally cylindrically-shaped main body portion, a neck portion, and a shoulder portion connecting the neck portion to the main body portion;

a load plate secured to the housing;

at least one fluid inlet formed in the housing; and a casing hanger adapted to fit within the housing;

wherein the neck portion of the housing has a recess formed therein;

wherein the casing hanger is disposed within the recess formed in the neck portion of the housing; and wherein a removable split casing ring is disposed between the casing hanger and the recess;

a flexible disc disposed between the removable split casing ring and the recess; and a flexible disc disposed between the removable casing ring and the casing hanger.

2. The apparatus of claim 1 further comprising a section of casing string disposed within the housing, wherein the casing string is hung from the casing hanger and adapted to mate with the casing.

3. The apparatus of claim 2 further comprising a limit clamp secured around an outer circumferential surface of the section of casing string, wherein the limit clamp is adapted to retain the section of casing string within the housing.

4. The apparatus of claim 3 wherein the limit clamp is removably secured to the outer circumferential surface of the section of casing string.

5. The apparatus of claim 4 wherein the limit clamp is formed into two semi-circular half sections.

6. The apparatus of claim 5 wherein the limit clamp is formed as a unitary ring that is capable of slipping onto the outer circumferential surface of the casing string.

7. The apparatus of claim 1 further comprising a flexible disc disposed between the casing hanger and the recess of the neck portion of the housing.

8. The apparatus of claim 1 wherein the casing hanger is defined by a threaded connector adapted to mate with a section of casing string.

9. The apparatus of claim 8 wherein the threaded connector is further adapted to mate with a handling sub, thereby enabling the housing to be lifted off the wellbore.

10. The apparatus of claim 1 wherein the load plate extends outwardly from the housing.

11. The apparatus of claim 1 wherein the housing is further defined by an upper section and a lower section, and the upper section of the housing is removably secured to the lower section of the housing.

12. The apparatus of claim 11 wherein a plurality of pins secure the upper section of the housing to the lower section of the housing.

13. A method of reverse circulation cementing a casing in an open-hole wellbore, comprising the steps of:

(a) installing the casing into the open-hole wellbore;

(b) installing a surface pack-off device at a surface opening of the open-hole wellbore, wherein:

the pack-off device comprises:

a housing;

a casing hanger suspended from the housing;

a section of casing string suspended from the casing hanger; and a load plate secured to the housing;

an annulus is formed between the section of casing string and the housing; and a lower portion of the housing and the load plate cooperate to prevent collapse of the wellbore at the surface;

(c) connecting the section of casing string to the casing; and (d) pumping cement down the annulus.

14. The method of claim 13 wherein the surface pack-off device remains permanently installed at the surface opening of the wellbore after the casing has been cemented to a sidewall of the wellbore.

15. The method of claim 13 wherein the lower section of the housing and the load plate remain permanently installed at the surface opening of the wellbore after the casing has been cemented to a sidewall of the wellbore while the remaining components of the pack-off device are removed for reuse at another wellbore site.

16. The method of claim 13 further comprising the step of retaining the section of casing string within the housing using a limit clamp secured to an outer circumferential surface of the section of casing string.

17. The method of claim 13 wherein step (a) is performed by lowering the casing into the wellbore with elevators and one or more support members.

18. The method of claim 13 wherein step (b) is performed by stabbing the casing with the surface pack-off device.

19. The method of claim 18 wherein the stabbing step is performed using a handling sub.

* * * * *